United States Patent [19]

French

[11] Patent Number: 5,070,637

[45] Date of Patent: Dec. 10, 1991

[54] TELESCOPE SIGHT MOUNT

[75] Inventor: Kendrick L. French, Lebanon, Me.

[73] Assignee: K. W. Thompson Tool Company, Inc., Rochester, N.H.

[21] Appl. No.: 455,630

[22] Filed: Dec. 22, 1989

[51] Int. Cl.[5] ..... F41G 1/387

[52] U.S. Cl. ..... 42/101; 33/250

[58] Field of Search ..... 42/101, 103, 100; 33/245, 250

[56] References Cited

U.S. PATENT DOCUMENTS

| | | | |
|---|---|---|---|
| 2,450,466 | 1/1948 | Carlson | 33/250 |
| 2,452,145 | 1/1948 | Pike | 33/250 |
| 2,510,289 | 1/1950 | Livermore | 33/250 |
| 2,620,565 | 1/1952 | Boughton | 33/250 |
| 2,649,779 | 1/1953 | Hardgrove | 33/250 |
| 2,942,346 | 6/1960 | Staubach | 33/250 |
| 3,205,579 | 2/1965 | Plisk | 33/250 |
| 4,027,414 | 1/1977 | Felix | 42/101 |

*Primary Examiner*—Charles T. Jordan
*Assistant Examiner*—Michael J. Carone
*Attorney, Agent, or Firm*—Norman S. Blodgett; Gerry A. Blodgett

[57] ABSTRACT

Mount for telescopic sight consisting of a base portion with cross pins and a ring portion with a spring-loaded plunger.

8 Claims, 2 Drawing Sheets

TELESCOPE SIGHT MOUNT

BACKGROUND OF THE INVENTION

In the design and operation of telescopic gun sights, it is common practice to provide the sight and the gun with interengaging parts that permit the sight to be removed from the gun when not being used. This prevents damage to the sight and permits separate transportation and storage of the gun and of the sight. While this arrangement is convenient, it also presents certain problems. For instance, if the sight is accurately aligned while mounted on the gun, the setting may be disturbed by the removal from and later replacement of the sight on the gun. Furthermore, in some sight systems, the alignment for elevation and windage takes place in the mount and such an arrangement requires a delicate mechanism that can be easily damaged when stored and transported on the gun. These and other difficulties with the prior art devices have been obviated in a novel manner by the present invention.

It is, therefore, an outstanding object of the present invention to provide a telescopic sight mount that permits the sight to be removed from and replaced on the gun without disturbing the alignment setting.

Another object of the invention is the provision of a sight mount that is rugged in construction, so that the possibility of damage is remote.

A further object of the present invention is the provision of a mount for a telescopic sight which is simple in construction, which is easy to manufacture, and which is capable of a long life of useful service with a minimum of maintenance.

It is another object of the present invention to provide a telescopic sight system in which the sighting adjustments do not take place in the gun mount and, therefore, are not subject to misalignment during transport and storage of the gun.

A still further object of the invention is a telescopic sight system that permits the sight to be moved from one gun to another when necessary or desirable.

With these and other objects in view, as will be apparent to those skilled in the art, the invention resides in the combination of parts set forth in the specification and covered by the claims appended hereto.

SUMMARY OF THE INVENTION

In general, the present invention relates to a telescopic sight mount for a gun, in which the mount has an elongated base portion adapted to be fastened to the gun, the base portion having an abutment extending upwardly from each end. Each abutment is formed with a recess having upper inclined surfaces forming a V-shaped notch which is adapted to receive the telescopic sight and to locate it, so that its axis is parallel to and spaced from the centerline of the gun barrel. An elongated ring portion is provided having a ring at each end to embrace the telescopic sight. A cross pin extends across each recess of the base portion below the said inclined surfaces, one end of the ring portion having an extension adapted to fit under the cross pin at the front of the base portion; and a spring-loaded plunger is mounted at the other end of the ring portion and has an inclined, upwardly-directed end surface that engages the cross pin at the rear end of the base portion.

More specifically, the base portion has a flat upper surface adapted to engage a similar flat lower surface of the ring portion. The flat upper surface of the base portion extends into the said recesses and defines the bottom of each recess, and the flat lower surface of the ring portion extends into the said extension and serves as its undersurface. The said extension is provided with an upper surface that is parallel to and spaced from the undersurface, so that it fits under the front cross-pin of the base portion. The said extension also has an inclined surface intersecting the said upper surface, which inclined surface engages the cross pin to press the undersurface of the extension tightly downwardly against the said flat upper surface of the base portion.

DESCRIPTION OF THE PREFERRED EMBODIMENT

Figure 1:
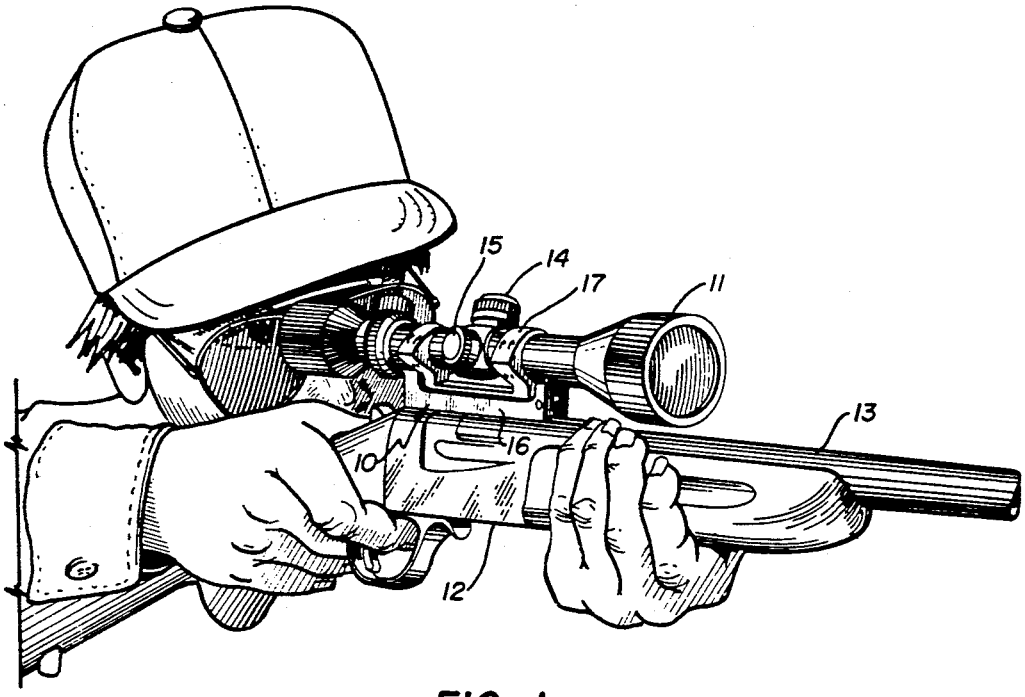
FIG. 1 is a perspective view of a mount embodying the principles of the present invention and shown in use with a telescopic sight and a gun.

Referring first to FIG. 1, wherein are best shown the general features of the invention, it can be seen that the mount, indicated generally by the reference numeral 10, is shown connecting a telescopic sight 11 to a gun 12 having a barrel 13. The telescopic sight 11 has an internal reticle (not shown) that is adjustable vertically by an elevation knob 14 and horizontally by a windage knob 15. The mount 10 is made up of a base portion 16 and a ring portion 17.

Figure 2:
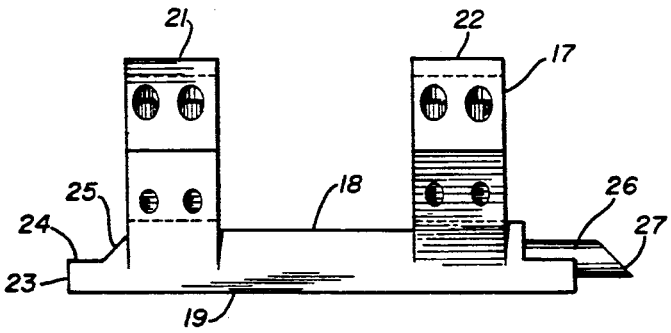
FIGS. 2 and 3 are front elevational and rear end elevational views, respectively, of a ring portion forming part of the mount.
Figure 3:
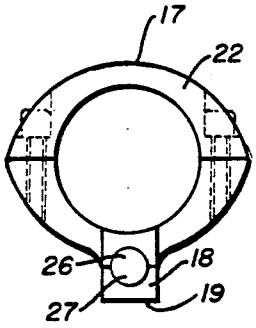

Referring now to FIGS. 2 and 3, it can be seen that the ring portion 17 has an elongated rectangular main body 18 having a flat undersurface 19. The front end of the main body is provided with a ring 21, while the rear end is provided with a similar ring 22. Each ring is formed in two parts that are joined by bolts to permit them to embrace tightly the telescopic sight. Extending from the front end of the main body is an extension 23 which shares the undersurface 19 and has a spaced, parallel upper surface 24 leading to an inclined surface 25. Extending from the rear end of the main body 18 is a spring-loaded plunger 26 having an upwardly-facing inclined surface 27.

Figure 4:
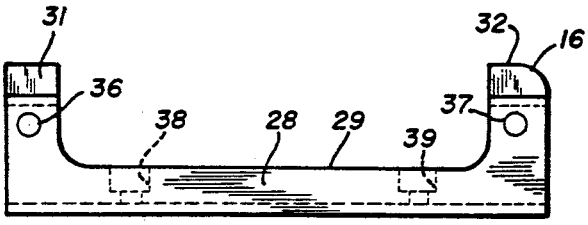
FIGS. 4 and 5 are front elevational and rear end elevational views, respectively, of a base portion of the mount.
Figure 5:
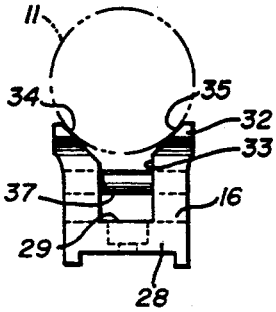

FIGS. 4 and 5 illustrate the details of construction of the base portion 16, which has a generally rectangular main body having a flat upper surface 29. Extending upwardly from the main body at the front and rear ends are abutments 31 and 32, respectively. The rear abutment 32 (which is similar to the abutment 31) is divided vertically into two parts by a recess 33 whose bottom surface is an extension of the upper surface 29 of the main body 28. The upper part of the recess 33 is shaped to provide opposed, upwardly-directed inclined surfaces 34 and 35 defining a V-shaped notch which is adapted to receive the cylindrical outer surface of the telescopic sight 11. The front abutment 31 is provided with a similar recess, inclined surfaces, and a portion of the upper surface 29 of the main body. The abutments 31 and 32 are provided with cross pins 36 and 37 whose axes are spaced from and parallel to the upper surface 29 of the main body. Suitable bores 38 and 39 are provided to fasten the base portion 16 to the gun 12 by means of socket-head bolts (not shown).

Figure 6:
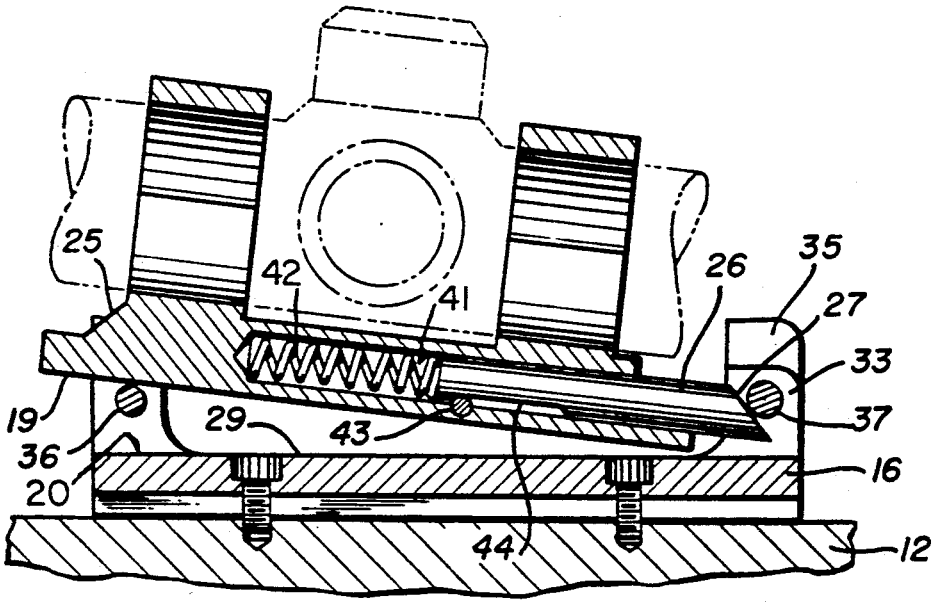
FIG. 6 is a vertical sectional view of the mount at an intermediate stage in assembly.
Figure 7:
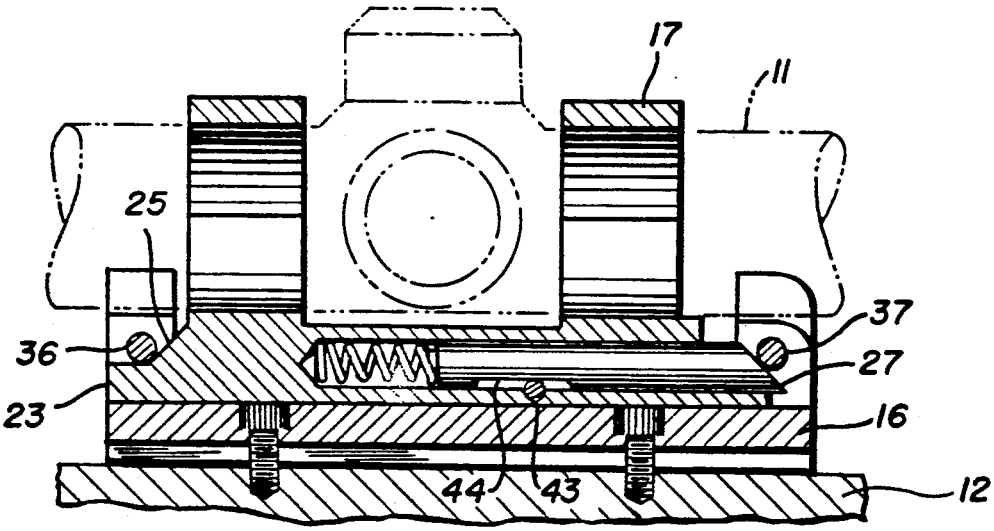
FIG. 7 is a vertical sectional view of the mount at the completed stage in assembly.

FIGS. 6 and 7 illustrate the operation of the mount; the base portion 16 is bolted to the gun 12 and the ring portion 17 is mounted on the telescopic sight 11. The telescopic sight 11 with the ring portion 17 mounted on it is moved rearwardly relative to the gun 12 and the base portion 16 in such a way that the plunger 26 is inserted between the cross pin 37 and the upper surface 29 of the base body within the recess 33. The inclined surface 27 of the plunger engages the surface of the cross pin 37, as shown in FIG. 6. As the movement of the sight and the ring portion continues (to the right in the drawing), the plunger 26 retracts into its bore 41, compressing the coil spring 42. It should be noted at this point that the longitudinal movement of the plunger 26 in its bore 41 is limited by a cross pin 43 lying in a recess 44 formed on the plunger.

During the above-described movement, the undersurface 19 of the main body of the ring portion rests on the cross pin 36. Eventually, the movement to the right (rearward of the gun) reaches the point where the extension 23 can be moved downwardly past the cross pin 36 until the undersurface 19 of the ring portion rests on the uppersurface 20 of the base portion. At that time, the coil spring 42 has been greatly compressed by the inward movement of the plunger 26.

The telescopic sight and the ring portion of the mount are then slowly released, causing the spring pressure to press the extension 23, so that it slides under the cross pin 36. Eventually, the pin reaches the inclined surface 25 on the extension and this serves to cam the ring portion downwardly, so that the undersurface 19 of the ring portion engages the upper surface 29 of the base portion; at the same time, the telescopic sight is pulled snugly into the V-shaped notch in the abutment. Similarly, the pressure of the front cross pin 37 on the inclined surface 27 of the plunger pulls the ring portion downwardly and presses the telescopic sight snugly into the V in the recess 33 in the rear abutment 32 of the base portion.

The advantages of the invention will now be readily understood in view of the above description. Because the system involves the use of a telescopic sight whose internal reticle is adjustable for elevation and windage by use of the knobs 14 and 15, the base and ring portions of the mount can be constructed simply and ruggedly. This means that the alignment and compensation that have been set for a given target distance and conditions are maintained, even when the gun is subjected to rough handling. The telescopic sight with the ring portion of the mount can be carried in a separate container, but can be rapidly assembled with the base portion with considerable accuracy. The elevation and windage settings will then be exactly as they were previously determined by the well-known trial-and-error method. Furthermore, because of the fact that the telescopic sight can be removed (without disturbing the setting when remounted), the rifle does not carry the awkward appendage otherwise provided by the sight when mounted on the gun. Under certain conditions, also, it is possible to rapidly replace a given telescopic sight with another sight which is of a different type or is provided with a different setting of elevation and windage. Furthermore, a given telescopic sight can be readily moved from one gun to another, by providing each gun with its own base portion.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A telescopic sight system for a gun, comprising:

(a) a telescopic sight having a reticle with an elevation adjusting knob and a windage adjusting knob to adjust the reticle for elevation and windage, (b) an elongated base portion to be fastened to the gun, the base portion having an abutment extending upwardly from each end, each abutment being formed with a recess having upper inclined surfaces to define a V-shaped notch that is adapted to receive the telescopic sight and to locate it, so that its axis is generally parallel to and spaced from the centerline of the gun barrel, and (c) an elongated ring portion having a ring at each end to embrace the telescopic sight, wherein a cross pin extends across each recess of the base portion below the said inclined surfaces, wherein one end of the ring portion has an integral extension adapted to fit under the cross pin at one end of the base portion, and wherein a spring-loaded plunger is mounted in the other end of the ring portion and has an inclined, upwardly-directed end surface that engages the cross pin at the other end of the base portion.

2. Telescopic sight mount for a gun, comprising:

(a) an elongated base portion adapted to be fastened to the gun and having an abutment extending upwardly from each end, each abutment being formed with a recess having upper inclined surfaces forming a V-shaped notch whose surfaces are adapted to contact and receive the telescopic sight and to locate it, so that its axis is parallel to and spaced from the centerline of the gun barrel, and (b) an elongated ring portion having a ring at each end to embrace the telescopic sight, wherein a cross pin extends across each recess of the base portion below the said inclined surfaces, wherein one end of the ring portion has an extension adapted to fit under the cross pin at one end of the base portion; and wherein a spring-loaded plunger is mounted in the other end of the ring portion and has an inclined, upwardly-directed end surface that engages the cross pin at the other end of the base portion.

3. A gun telescope mount as recited in claim 2, wherein the base portion has a flat upper surface adapted to engage a similar flat lower surface of the ring portion.

4. A gun telescope mount as recited in claim 3, wherein the flat upper surface of the base portion extends into the said recesses and defines the bottom of each recess, and wherein the flat lower surface of the ring portion extends into the said extension and serves as its undersurface.

5. A gun telescope mount as recited in claim 4, wherein the said extension is provided with an upper surface that is parallel to and spaced from the undersurface, so that it fits under the cross pin at the said one end of the base portion.

6. A gun telescope mount as recited in claim 5, wherein the said extension has an inclined surface intersecting its said upper surface, which inclined surface engages the cross pin at the said one end of the base portion to press the undersurface of the extension tightly downwardly against the said flat upper surface of the base portion.

7. Telescopic sight mount for a gun, comprising:

(a) an elongated base portion adapted to be fastened to the gun and having an abutment extending upwardly from each end, each abutment being formed with a recess having upper inclined surfaces forming a V-shaped notch whose surfaces are adapted to contact and receive the telescopic sight and to locate it, so that its axis is parallel to and spaced from the centerline of the gun barrel, and (b) an elongated ring portion having a ring at each end to embrace the telescopic sight, wherein a cross pin extends across each recess of the base portion below the said inclined surfaces, wherein one end of the ring portion has an extension adapted to fit under the cross pin at one end of the base portion; wherein a spring-loaded plunger is mounted in the other end of the ring portion and has an inclined, upwardly-directed end surface that engages the cross pin at the other end of the base portion, wherein the base portion has a flat upper surface adapted to engage a similar flat lower surface of the ring portion, and wherein the said extension is provided with an upper surface that is parallel to and spaced from the undersurface, so that it fits under the cross pin at the said one end of the base portion.

8. Telescopic sight mount for a gun, comprising:

(a) an elongated base portion adapted to be fastened to the gun and having an abutment extending upwardly from each end, each abutment being formed with a recess having upper inclined surfaces forming a V-shaped notch whose surfaces are adapted to contact and recieve the telescopic sight and to locate it, so that its axis is parallel to and spaced from the centerline of the gun barrel, and (b) an elongated ring portion having a ring at each end to embrace the telescopic sight, wherein a cross pin extends across each recess of the base portion below the said inclined surfaces, wherein one end of the ring portion has an extension adapted to fit under the cross pin at one end of the base portion; and wherein a spring-loaded plunger is mounted in the other end of the ring portion and has an inclined, upwardly-directed end surface that engages the cross pin at the other end of the base portion, wherein a flat upper surface of the base portion extends into the said recesses and defines the bottom of each recess, wherein a flat lower surface of the ring portion extends into the said extension and serves as its undersurface, and where the said extension has an inclined surface intersecting the said upper surface, which inclined surface engages the cross pin at the said one end of the base portion to press the inclined surface intersecting the said upper surface, which inclined surface engages the cross pin at the said one end of the base portion to press the undersurface of the extension tightly downwardly against the said flat upper surface of the base portion.

* * * * *